United States Patent [19]

Hoshi et al.

[11] Patent Number: 4,822,702

[45] Date of Patent: Apr. 18, 1989

[54] METHOD FOR FORMING MULTI-COLOR TONER IMAGE

[75] Inventors: Nobuyoshi Hoshi; Masayasu Anzai, both of Hitachi; Isamu Komatsu, Takahagi; Susumu Akimaru, Hitachi, all of Japan

[73] Assignee: Hitachi, Ltd., Tokyo, Japan

[21] Appl. No.: 434,555

[22] Filed: Oct. 15, 1982

[30] Foreign Application Priority Data

Oct. 26, 1981 [JP] Japan ..... 56-170141
Feb. 12, 1982 [JP] Japan ..... 57-19615

[51] Int. Cl.[4] ..... G03G 15/01
[52] U.S. Cl. ..... 430/42; 432/126
[58] Field of Search ..... 430/42, 54, 100, 126

[56] References Cited

U.S. PATENT DOCUMENTS 3,901,698 8/1975 Fulcushima et al. ..... 430/100
4,078,929 3/1978 Gundlach ..... 430/42

FOREIGN PATENT DOCUMENTS 55-87173 7/1980 Japan .

*Primary Examiner*—John L. Goodrow
*Attorney, Agent, or Firm*—Antonelli, Terry & Wands

[57] ABSTRACT

A toner of a first color incorporated into a development appartaus for second color is charged to a polarity opposite to a polarity of a charge of an electrostatic latent image for the second color by a frictional action with a toner in the development apparatus for the second color. The toner of the first color incorporated into the second development apparatus is caused to adhere to a charge-non-released region of a drum, whereby accumulation of the first toner in the second color development apparatus is prevented. The first and second toners are electrostatically transferred onto a paper by a bias electric field having a polarity opposite to that of the toner images, whereby at reversal development of the second color, the toner of the first color adhering to the charge-non-released region is prevented from being transferred onto the paper. Further, the toner of the first color, incorporated in the second development apparatus, changed reversly in its polarity, or reduced to about zero in the charge quantity can be removed by electrical and mechanical removal means provided in the second development apparatus.

6 Claims, 2 Drawing Sheets

METHOD FOR FORMING MULTI-COLOR TONER IMAGE

BACKGROUND OF THE INVENTION

The present invention relates to a method for forming a multi-color toner image. More particularly, the present invention relates to a method for forming a multi-color toner image in which a multi-color toner image is formed by developing at least two electrostatically latent images formed on one photosensitive material by toners differing in the color.

Development of a printer capable of recording a toner image having at least two colors as a terminal device of a computer or the like has been desired. A printer according to the electrophotographic process is practical as the printer of this type, and a laser beam printer has been proposed. In a two-color laser printer, a rotary photoconductive photosensitive drum is uniformly charged and the photosensitive drum is subjected to negative light exposure with a first laser beam modulated by a first image information to form a first electrostatic latent image, and this first electrostatic latent image is subjected to reversal development in a first development apparatus to cause a first toner to adhere to a charge-released region and form a first toner image. Then, the photosensitive drum is subjected again to negative light exposure with a second laser beam modulated by a second image information to form a second electrostatic latent image, and this second electrostatic latent image is subjected to reversal development in a second development apparatus to cause a second toner to adhere to the charge-discharged region and form a second toner image. The two-color toner image thus formed on the surface of the photosensitive drum is transferred onto a recording paper and fixed thereto.

In the method for forming a two-color toner image by the above-mentioned laser beam printer, while the second electrostatic latent image is developed, a part of the first toner which has already adhered to the photosensitive drum is separated from the drum and incorporated in the second development apparatus, and with increase of the amount of the incorporated first toner, the second toner image becomes turbid.

As the method for normally developing two colors, there has been proposed in Japanese laying-open of patent application No. 55-87173 a method in which when the other of the first development apparatus is incorporated in the second development apparatus, the incorporated first toner is reversely charged to the same polarity as that of the charge of the second latent image by frictional charging with a carrier of the second developer, whereby adhesion of the first toner to the photosensitive drum is inhibited and mingling of colors is thus prevented. In this method for normally developing two colors, since the second toner adheres to the periphery of the carrier of the second developer, the chance of frictional contact of the first toner with the carrier in the second developer is reduced and a long time is required for reversal of the charge polarity. Accordingly, there is a risk of adhesion of the first toner to the second electrostatic latent image before reversal of the charge polarity. Furthermore, since the toner having the charge polarity thereof reversed is left in the second development apparatus, in a system provided with for uniformly controlling the toner mixing ratio in the developer or the amount of the developer, the amount of the second toner is reduced in correspondence to the amount incorporated of the first toner, and therefore, the development capacity of the second development apparatus is reduced.

SUMMARY OF THE INVENTION

It is therefore an object of the present invention to provide a method for forming a multi-color toner image, in which a toner image of at least two colors having a good quality can be stably obtained without mingling of colors.

In order to attain this object, according to the invention, a toner of a first color incorporated into a development apparatus for a second color is charged to a polarity opposite to a polarity of a charge of an electrostatic latent image for the second color by a frictional action with a toner in the development apparatus for the second color.

The toner of the second color is caused to adhere to the charge-released region at the reversal development of the second color to form a toner image of the second color. In this case, for example, the toner of the first color incorporated into the second development apparatus is caused to adhere to the charge-non-released region, whereby accumulation of the first toner in the development apparatus of the second color is prevented. Then, the first and second toner images are electrostatically transferred onto a recording paper by a bias electric field having a polarity opposite to that of the toner images, whereby at reversal development of the second color, the toner of the first color adhering to the charge-non-released region (the polarity is the same as that of the bias electric field) is prevented from being transferred onto the recording paper. Further, the toner of the first color incorporated into the second development apparatus and changed reversedly in its polarity can be removed from the system by providing means for removing the toner incorporated in the second development apparatus before adhering to the charge-non-released region.

DESCRIPTION OF THE PREFERRED EMBODIMENT

The invention will now be described in detail with reference to embodiments illustrated in the accompanying drawings.

Figure 1:
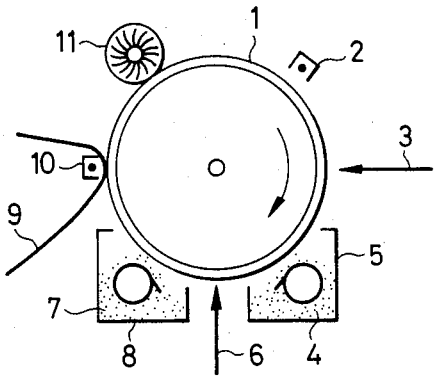
FIG. 1 is a side view illustrating the entire structure of a two-color electrophotographic apparatus used in carrying out the invention.
Figure 2:
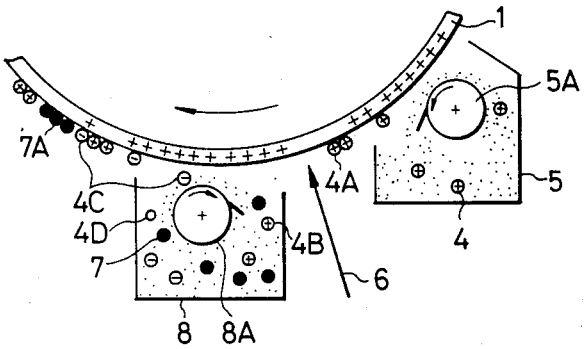
FIG. 2 is an enlarged view of the development zone of the apparatus shown in FIG. 1.

FIG. 1 is a side view showing the entire structure of a two-color electrophotographic apparatus for use in carrying out the invention, and FIG. 2 is an enlarged view showing the development zone of the apparatus shown in FIG. 1. The surface of a photoconductive photosensitive drum 1 rotated clockwise is uniformly charged to, for example, a positive polarity by a charging device 2. The uniformly charged surface of the photosensitive drum is subjected to negative light exposure with a beam 3 containing a first image information, or with a laser beam modulated by the first image information, to form a first electrostatic latent image, and this first electrostatic latent image is subjected to reversal development by a first development apparatus 5 containing a first toner 4 (exaggeratively indicated by a white circle) charged to the same positive polarity as that of the charge of the latent image. By this reversal development, the first toner 4 is caused to adhere to the charge-released region of the photosensitive drum 1 to form a first toner image 4A.

At the next step, the photosensitive drum 1 having the first toner image 4A formed thereon is subjected again to negative light exposure with a beam 6 containing a second image information, or with a laser beam modulated by the second image information, to form a second electrostatic latent image, and this second electrostatic latent image is subjected to reversal development by a development apparatus 8 containing a second toner 7 (exaggeratively indicated by a black circle) charged to the same positive polarity as that of the charge of the latent image. By this reversal development, the second toner 7 is caused to adhere to the zone where the charge is released by the second light exposure to form a second toner image 7A. Accordingly, if toners differing in the color are selected as the first toner 4 and second toner 7, a two-color toner image can be formed on the surface of the photosensitive drum 1. A recording paper 9 is brought into contact with the surface of the photosensitive drum 1 having the two-color toner image 4A, 7A and a bias electric field having a polarity opposite to that of the toner image is applied to the back face of the recording paper 9 by a charging device 10, whereby the two-color toner image is electrostatically transferred onto the surface of the recording paper 9. After transfer of the toner image 4A, 7A, the surface of the photosensitive drum 1 is cleaned by a cleaner 11 and is uniformly charged again by the charging device 2.

In this electrophotographic apparatus, in the case where the first development apparatus 5 uses the toner 4 together with a magnetic carrier and a magnetic brush of a two-component type developer is formed on the surface of a development roll 5A, the toner 4 is charged to a positive polarity by frictional charging with the carrier. Furthermore, the toner 7 of the second development apparatus 8 is used together with a magnetic carrier and the toner is charged to a positive polarity by frictional charging with the carrier, and in this state, a magnetic brush of a two-component type developer is formed on the surface of a development roll 8. When the second electrostatic latent image is developed by the second development apparatus 8, since the first toner image 4A of the first toner 4 is formed on the surface of the photosensitive drum 1, a part of the first toner 4 is peeled from the surface of the photosensitive drum 1 and incorporated into the second development apparatus 8. When the amount of the first toner 4B incorporated into the second developer apparatus 8 is increased, if the first toner 4 retains the charge of the positive polarity, the first toner 4 as well as the second toner 7 adheres to the second electrostatic latent image to render the second toner image turbid.

In the present embodiment, occurrence of this undesirable phenomenon is prevented by selecting the toner materials so that the order of frictional charging of the first toner 4 is located between the magnetic carrier used for the second development apparatus 8 and the second toner 7. Namely, the toners are selected so that the average charge quantity of the second toner 7 is made larger than that of the first toner 4 for example by 5~20 μc/g. Thus, the charge polarity of most of the first toner 4B incorporated into the second development apparatus 8 is promptly reversed to the negative polarity by frictional charging with the second toner 7, and the resulting toner 4C of the opposite polarity adheres to the charge-non-released region (the non-image region where the latent image charge of the positive polarity is left) of the photosensitive drum 1 and is removed from the second development apparatus 8. Accordingly, accumulation of the first toner in the second development apparatus 8 is prevented. Therefore, the first toner image 4A having the charge of the positive polarity, the second toner image 7A having the charge of the positive polarity and the excessive first toner 4C having the charge of the negative polarity adhere to the surface of the photosensitive drum 1. However, since electrostatic transfer of the toner image is accomplished by applying a bias charge of the negative polarity to the recording paper 9, the positively charged first and second toner images 4A and 7A are attracted by this bias charge and transferred onto the recording paper 9, while the negatively charged excessive first toner 4C is repelled by the bias charge and is not transferred to the recording paper 9. Accordingly, contamination of the recording paper is prevented.

The charge of a small amount of the first toner 4B incorporated into the second development apparatus 8 is reduced to about zero. A further small amount of the first toner 4B is hardly charged in its polarity. The toner 4D the polarity of which is hardly changed is subjected to development together with the second toner 7A so that it is removed from the second development apparatus, and is not accumulated therein. The toner 4D adhered to the paper 9 is not made turbid since the quantity of the toner 4D is much less than the second toner 7A.

The phenomenon that the charge quantity of the first toner 4B is reduced to about zero or the polarity of the toner 4B changed reversely occurs when the above-mentioned difference of the average charge quantity resides between the first and second toners 4 and 7 even if the first and second carriers are the same.

It is seen that this phenomenon is not caused by the carried but is caused between the first and second toners 4B and 7. It is believed that since the second toner is more readily charged, this phenomenon is caused by friction of the toners 4B and 7 with each other. The change of the charge quantity of the incorporated first toner 4B is confirmed by the fact that when a positive charge of about 1000 V is applied to a counter electrode contacted with or brought close to the second developer in which the first toner 4B is incorporated, the first toner 4C adheres well to this electrode (the polarity is reversed to the opposite polarity) and only the first toner 4D is well scattered in the place where the flow of the developer is disturbed when the charge quantity is small, the force of adhering to the carrier is small.

The toners to be used in the invention will now be described. It has been found that when a black toner is used as the first toner 4, good results are obtained by use of a toner formed by kneading a styrene-butyl methacrylate copolymer resin, carbon black and a Nigrosine dye at a weight ratio of 85:10:5, solidifying the kneaded mixture and pulverizing the solidified mixture, and that when a red toner is used as the second toner 7, good results are obtained by use of a toner formed by kneading a styrene-butyl methacrylate copolymer resin and Watchung Red at a weight ratio of 96:4, solidifying the kneaded mixture and pulverizing the solidifed mixture. As the magnetic carrier to be used together with the above-mentioned toners 4 and 7 in the development apparatuses 5 and 8, DSP-1580 supplied by Nippon Teppun Kabushiki Kaisha is preferred, and the blow-off charge quantities of the first and second toners 4 and 7 to this carrier are 25 μc/g and 37 μc/g, respectively.

The difference of the average charge quantity between the first and second toners is important, and the absolute values of the average charge quantities of both the toners are not particularly significant but in view of practical properties such as scatteirng and developing properties, it is preferred that the average charge quantity of the first developer be about 20 μc/g and the average charge quantity of the second toner be about 35 μc/g. The charge quantity of the developer can be obtained by controlling an amount of charge control agents such as Nigrosine dye and Watchung Red.

Figure 3:
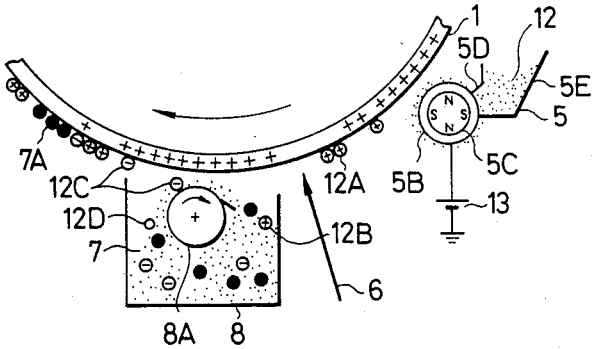
FIG. 3 is a side view illustrating another embodiment of the development zone.

FIG. 3 shows a modification of the electrophotographic apparatus shown in FIGS. 1 and 2, in which a development apparatus for a onecomponent type toner is disposed instead of the first development apparatus 5. The first development device 5 shown in FIG. 3 comprises a cylindrical electroconductive sleeve 5B, a magnetic roll 5C, a toner regulating plate 5D and a toner vessel 5E. A one-component type magnetic toner 12 contained in the toner vessel 5E is attracted by the magnetic roll 5C to form a magnetic brush on the periphery of the sleeve 5B, and when the magnetic roll 5C is moved counterclockwise, the thickness of the magnetic brush is regulated by the regulating plate 5D and the magnetic brush is moved counterclockwise on the surface of the sleeve to have a light rubbing contact with the surface of the photosensitive drum 1. When a bias voltage having the same polarity as that of the charge of the latent image on the surface of the photosensitive drum is applied to the sleeve 5B by a bias voltage source 13, reversal development becomes possible. The development conditions are changed according to properties of the one-component type toner 12 is used. When a high-resistance non-chargeable magnetic toner comprising a magnetic powder and a resin at a weight ratio of 45:55 is used, it is preferred that the distance between the photosensitive drum 1 and the sleeve 5B be adjusted to about 0.3 to about 0.5 mm, the thickness of the magnetic brush be controlled so that the toner 12 is allowed to have a light rubbing contact with the surface of the photosensitive drum 1 and a bias voltage substantially equal to the potential of the charge left on the non-exposed area of the photosensitive durm 1 be applied to the sleeve 5B. When a high-resistance chargeable magnetic toner comprising a small amount of a dye as a charge controlling agent as well as a magnetic powder and a resin, which is positively charged, is used, a good reversal development characteristic is obtained when the distance between the photosensitive drum 1 and the sleeve 5B is adjusted to 0.2 to 0.3 mm, the thickness of the magnetic brush formed on the surface of the sleeve is controlled so that the magnetic brush does not fall in contact with the surface of the photosensitive drum and a bias voltage about 0.5 to about 1 time as high as the potential of the residual charge is applied to the sleeve 5B. As in the above-mentioned first embodiment, the surface of the photosensitive drum having the first toner image 12 formed thereon by the first development apparatus 5 is subjected to negative light exposure with a second beam 6, and reversal development is performed by the second development apparatus 8 to form a second toner image 7A. Also in this embodiment, a part of the first toner 12 is incorporated in the second development apparatus, but the majority of the incorporated toner 12B in negatively charged by the frictional charging with the second toner 7, and the resulting toner 12C of the opposite polarity adheres to the charge-non-discharged region of the surface of the photosensitive drum and is removed from the interior of the second development apparatus.

In the present embodiment, by using a one-component type magnetic toner as the first toner 12, the size of the first development apparatus 5 is reduced and the structure of the apparatus 5 is simplified. Furthermore, the present embodiment is advantageous in that since a part of the magnetic powder is exposed to the surface of the one-component type magnetic toner and the frictional chargeability with the second toner 7 is enhanced, the majority of the incorporated toner is readily charged to an opposite polarity and removed from the development apparatus.

Figure 4:
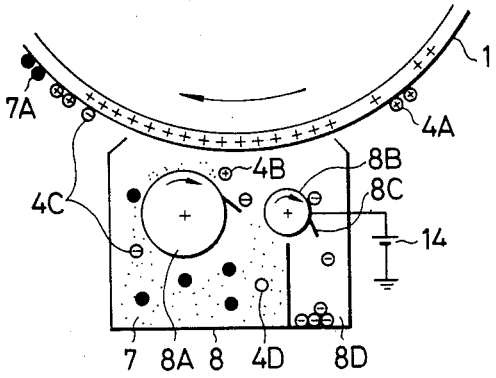
FIG. 4 is a side view illustrating still another embodiment of the development zone.

FIG. 4 illustrates a modification of the electrophotographic apparatus shown in FIGS. 1 and 2, in which a magnetic toner comprising 10 to 50% by weight of a magnetic powder is used as the first toner 4 in the form of a mixture with a magnetic carrier and means for removing the incorporated toner is disposed for the second development apparatus 8. The first development apparauts 5 is omitted only for the simplicity of explanation. An electroconductive rotary electrode 8B is arranged in the second development apparatus 8, and a voltage of the same polarity as that of the charge on the surface of the photosensitive drum is applied to the rotary electrode 8B from a power source 14. The toner attracted to the rotary electrode 8B is removed by a scraper plate 8C and let to fall down into a recovery zone 8D.

In the present embodiment, the toner 4C of the opposite polarity incorporated in the second development apparatus 8 is caused to adhere to surface of the photosensitive drum 1 and is removed from the second development apparatus 8, and simultaneously, the toner 4C is also caused to adhere to the rotary electrode 8B and is recovered in the recovery zone 8D. In the present embodiment, since the first toner 4 contains the magnetic powder, the frictional chargeability with the second toner 7 is enhanced and the first toner 4 is readily charged to the opposite polarity. Moreover, since the first toner is mixed with the carrier and is used in the state charged to the same polarity as that of the charge of the latent image, a bias voltage source for reversal development becomes unnecessary.

In the present invention, a one-component magnetic toner may be used for each of the first and second toners.

In the invention, it is necessary that the first toner should be charged to a polarity opposite to that of the charge of the latent image formed on the surface of the photosensitive drum by the frictional charging with the second toner. However, the degree of the charging can freely be adjusted according to the kind of the resin used, the kind of the charge control agent such as a pigment or dye and the presence or absence of a magnetic powder. From the results of many tests made by us, it has been confirmed that when the same carrier is used, the object of the invention can be attained advantageously if the toner materials are selected so that the charge quantity of the second toner is larger than the charge quantity of the first toner. Furthermore, different kinds of carriers may be used for the first and second development apparatuses, respectively.

Figure 5:
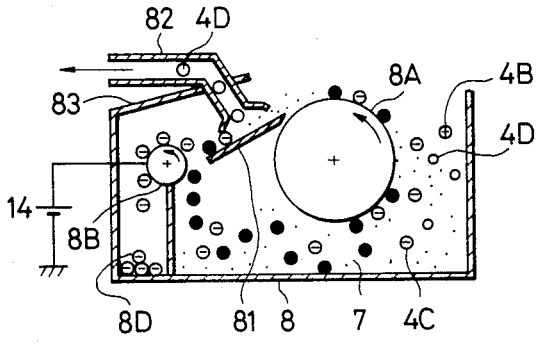
FIG. 5 is a side view illustrating still another embodiment of the development zone.

As the auxiliary means for removing the first toner incorporated in the second development apparatus, there can be used means utilizing the difference of the scattering property or magnetic property between both the toners. Although the charge polarity of the majority of the first toner incorporated in the second development apparatus is reversed, the charge quantity is small and the toner is readily scattered. Accordingly, as shown in FIG. 5, the incorporated and readily scattered toner can be sucked and removed by an air suction device 82 which is mounted on a scrupper member 81 in vicinity of the development roller 8A. Since the polarity of a part of the incorporated toner is hardly reversed, if this arrangement is adopted, even the toner, the charge polarity of which is hardly reversed, can be removed effectively.

As will be apparent from the foregoing description, according to the present invention, the toner of the first color incorporated in the reversal development apparatus for the second color is caused to adhere to the charge-non-released region of the photosensitive material by frictional charging to an opposite polarity with the charge of the latent image of the second color on the photosensitive material, whereby accumulation of the toner of the first color in the reversal development apparatus for the second color is prevented. Furthermore, by electrostatically transferring the first and second toner images on the photosensitive materil onto a recording paper by a bias electric field of the opposite polarity, the toner of the first toner charged to the opposite polarity and adhering to the photosensitive material is prevented from being transferred onto the recording paper. Accordingly, there can be attained an effect of stably obtaining a two-color toner image having a good quality without mingling of colors. Moreover, the method of the present invention can be developed to a method forming a toner image having at least three colors by increasing the repetition numbers of formation of electrostatic latent images and reversal development.

What is claimed is:

1. A method of forming multi-color toner images comprising the steps of:

forming a first electrostatic latent image corresponding to a first image information on a photoconductive photosensitive material;

charging a first toner for a first color to the same polarity as that of said first electrostatic latent image, said first toner being used in the form of a mixture with a carrier;

forming a first toner image on said photoconductive photosensitive material by reversal development of said first electrostatic latent image with said first toner charged;

forming a second electrostatic latent image corresponding to a second image information on said photoconductive photosensitive material;

charging a second toner for a second color different from said first color to the same polarity as that of said second electrostatic latent image, the average charge quantity of said second toner being larger than that of said first toner;

charging the first toner incorporated in the second toner to the polarity opposite to the polarity of the charge forming said electrostatic latent images, by frictional action between said first toner and said second toner;

forming a second toner image on said photoconductive photosensitive material by reversal development of said second electrostatic latent image with said second otner charged; and transferring electrostatically said first and second toner images on a recording medium.

2. A method of forming multi-color toner images comprising the steps of:

forming a first electrostatic latent image corresponding to a first image information on a photoconductive photosensitive material;

charging a first toner for a first color to the same polarity as that of said first electrostatic latent image, said first toner being used in the form of a mixture with a carrier;

forming a first toner image on said photoconductive photosensitive material by reversal development of said first electrostatic latent image with said first toner charged;

forming a second electrostatic latent image corresponding to a second image information on said photoconductive photosensitive material;

charging a second toner for a second color different from said first color to the same polarity as that of said second electrostatic latent image, said second toner being charged such that the average charge quantity is larger than that of said first toner by 5 to 20 $\mu c/g$;

charging the first toner incorporated in the second toner to the polarity oppposite to the polarity of the charge forming said electrostatic latent images, by frictional action between said first toner and said second toner;

forming a second toner image on said photoconductive photosensitive material by reversal development of said second electrostatic latent image with said second toner charged; and transferring electrostatically said first and second toner images on a recording medium.

3. A method of forming multi-color toner images comprising the steps of:

forming a first electrostatic latent image corresponding to a first image information on a photoconductive photosensitive material;

charging a first toner for a first color to the same polarity as that of said first electrostatic latent image;

forming a first toner image on said photoconductive photosensitive material by reversal development of said first electrostatic latent image with said first toner charged;

forming a second electrostatic latent image corresponding to a second image information on said photoconductive photosensitive material;

charging a second toner for a second color different from said first color to the same polarity as that of said second electrostatic latent image, wherein the second toner is used in the form of a mixture with second carriers, and wherein the triboelectric series order of the first toner (T1), said second toner (T2) and said second carriers (C2) is $T2>T1>C2$;

charging the first toner incorporated in the second toner to the polarity opposite to the polarity of the charge forming said electrostatic latent images, by frictional action between said first toner and said second toner;

forming a second toner image on said photoconductive photosensitive material by reversal development of said second electrostatic latent image with said second toner charged; and transferring electrostatically said first and second toner images on a recording medium.

4. A method as defined in claim 2, wherein the average charge quantity of said first toner is about 20μc/g and that of said second toner is about 35μc/g.

5. A method of forming multi-color toner images comprising the steps of:

charging uniformly the surface of a rotary photoconductive photosensitive drum;

forming a first electrostatic latent image on said drum by exposure of laser beam modulated with a first image information;

charging a first toner in a first development apparatus to the same polarity as that of said first electrostatic latent image;

forming a first toner image by reversal development of said first electrostatic latent image with said first toner charged;

forming a second electrostatic latent image on said drum by exposure of laser beams modulated with a second image information;

chargin a second toner different in color from said first toner in a second development apparatus to the same polarity as that of said first and second latent images, said second toner being mixed with carriers in the second development apparatus, with the triboelectric series order of the second toner (T2), first toner (T1) and said carriers (C) being: T2>T1>C;

charging, by frictional action of the seocnd toner, a relatively large part of said first toner incorporated in said second development apparatus to have the opposite polarity to that of the charge forming said first and second latent image, and another part to have the charge quantity of about forming a second toner image by reversal development of said electrostatic latent image with said second charge toner; and transferring said first and second toner images on a recording paper by a bias electric field having a polarity opposite to the polarity of said first and second images.

6. The method as defined in claim 5, further including a step of separating said first toner in said second development apparatus from said second toner by at least one of electrostatic force and mechanical force.

* * * * *